United States Patent [19]

Frigon

[11] Patent Number: 4,563,333

[45] Date of Patent: Jan. 7, 1986

[54] DEODORIZING FITTING FOR AIR FILTERS

[76] Inventor: Walter J. Frigon, 591 California Ave., Bricktown, N.J. 08753

[21] Appl. No.: 643,413

[22] Filed: Aug. 22, 1984

[51] Int. Cl.[4] ..... A62B 7/08

[52] U.S. Cl. ..... 422/122; 55/279; 55/DIG. 31; 422/4

[58] Field of Search ..... 55/DIG. 31, 501, 511, 55/515, 387, 518, 279; 422/5, 122, 120, 4

[56] References Cited

U.S. PATENT DOCUMENTS

| | | | |
|---|---|---|---|
| 2,579,477 | 12/1951 | Dauphinee | 55/387 |
| 3,429,434 | 2/1969 | Hickin | 55/DIG. 31 |
| 3,643,040 | 2/1972 | Kaneyasu | 55/279 |
| 3,722,188 | 3/1973 | Cullen | 55/387 |
| 3,812,370 | 5/1974 | LaViolette | 55/279 |
| 3,902,877 | 9/1975 | Swaim | 55/279 |
| 4,028,073 | 6/1977 | Swaim | 55/279 |
| 4,065,262 | 12/1977 | Petroff | 55/279 |
| 4,118,226 | 10/1978 | Bourassa | 55/279 |
| 4,257,787 | 3/1981 | Taylor | 422/123 |
| 4,274,848 | 6/1981 | Gro | 55/387 |
| 4,306,892 | 12/1981 | Atalla et al. | 422/123 |
| 4,340,402 | 7/1982 | Catron | 55/511 |

FOREIGN PATENT DOCUMENTS

| | | | |
|---|---|---|---|
| 3017617 | 11/1981 | Fed. Rep. of Germany | 422/122 |
| 358591 | 4/1938 | Italy | 422/5 |

*Primary Examiner*—Bernard Nozick

*Attorney, Agent, or Firm*—Harvey B. Jacobson

[57] ABSTRACT

A deodorizing fitting is provided for an air filter used in air circulation ducting of a domestic dwelling or other building for deodorizing the circulating air. The fitting comprises a rectangular envelope of perforated cardboard with a deodorizing insert therein and adhesive-backed tabs on adjacent edges of the envelope for securing same in the corner of the filter.

2 Claims, 3 Drawing Figures

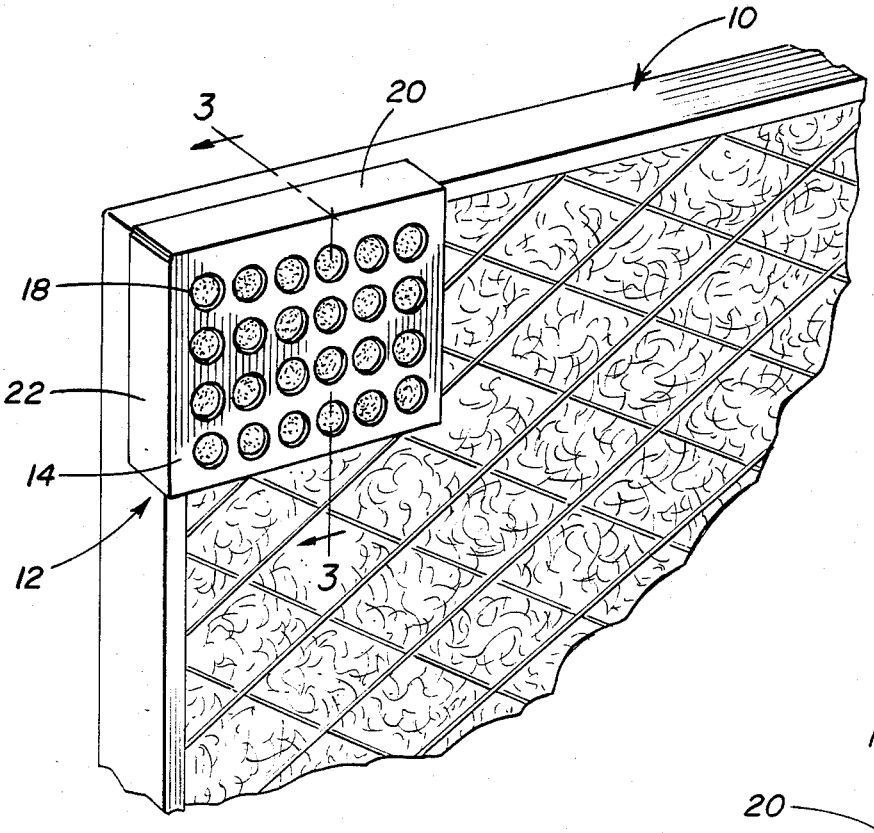
FIG. 1
FIG. 2
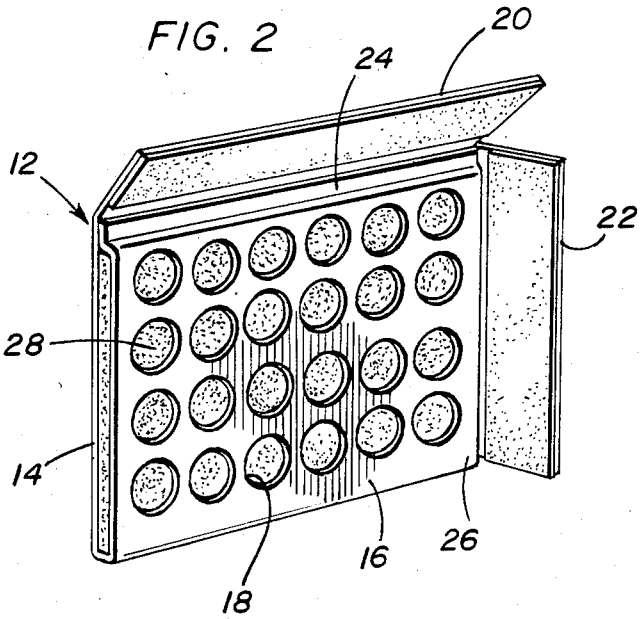
FIG. 3
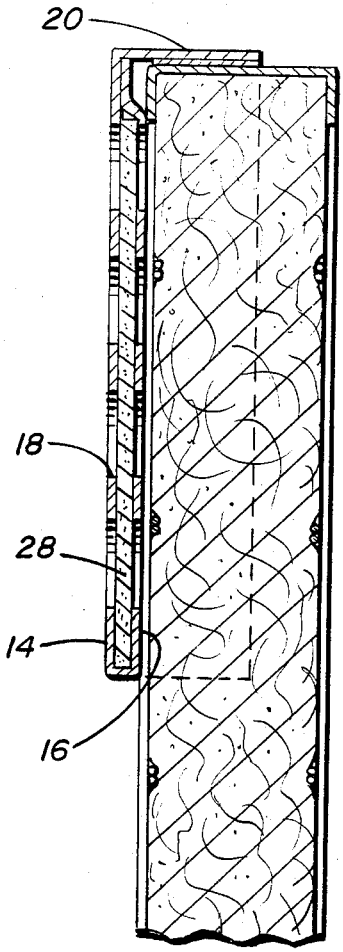

DEODORIZING FITTING FOR AIR FILTERS

BACKGROUND OF THE INVENTION

This invention relates to deodorizing systems for use in improving the odor of circulating air in domestic dwellings and other buildings. For example, when a furnace or air conditioning system is in operation in a building, outside doors and windows are kept closed, barring the entry of fresh air. Eventually the rooms of the building may assume a musty odor in general, and retain specific odors such as cooking odors. In order to dispel such odors it is common practice to use individual air fresheners in separate rooms of a building or to freshen rooms individually with aerosol fresheners or the like.

The present invention provides a simple and effective means for deodorizing air in a building without having to do this on a room-to-room basis, by associating a deodorizer fitting with a filter through which circulating air passes from a furnace or air conditioner.

STATEMENT OF PRIOR ART

Applicant is aware of the following U.S. patents, the relevance of which is that a number of the patents relate to deodorizing units associated with air filters and the like. None of these, however, discloses apparatus in accordance with the invention:

U.S. Pat. No. 3,643,090, Feb. 15, 1972.
U.S. Pat. No. 3,902,877, Sept. 2, 1975.
U.S. Pat. No. 4,028,073, June 6, 1977.
U.S. Pat. No. 4,065,262, Dec. 27, 1977.
U.S. Pat. No. 4,257,787, Mar. 24, 1981.

SUMMARY OF THE INVENTION

The present invention is based upon the concept of deodorizing air in a dwelling or other building having an air circulating system including an air filter, by associating a deodorizing means with the air filter so that the circulating air is deodorized on passage through the filter.

In a preferred form of the invention, for example, there is provided a deodorant packet or sachet comprising a substantially flat perforated packet containing a deodorant insert, and means for adhering or otherwise securing the packet to an air filter. The packet may be of rectangular form, and the adhering means may comprise adhesive tabs along adjacent sides of the packet, specifically adapted to secure same at a corner of the air filter with the tabs adhered along adjacent peripheral edges of the filter.

Alternatively, the invention contemplates the incorporation of solid deodorizing agents within otherwise conventional furnace-type air filters. The deodorants may be produced in varying scents such as lemon or pine.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an air filter to which is attached a deodorant fitting in accordance with the invention.

FIG. 2 is an enlarged perspective view of the fitting.

FIG. 3 is a sectional view on line 3—3 of FIG. 1.

DESCRIPTION OF THE PREFERRED EMBODIMENT

FIG. 1 shows a conventional form of flat rectangular pancake-type air filter 10 of the kind commonly located in a receiving slot in air-circulation ducting leading from a furnace or an air conditioning unit in a domestic dwelling or other building, and a deodorant sachet or packet 12 for securing on the filter in order to deodorize the circulating air as it passes through the filter.

Packet 12 may comprise, for example, a substantially flat rectangular cardboard packet having front and back panels 14 and 16, each formed with perforations 18, and adhesive-backed tabs 20, 22 along adjacent edges 24, 26 of the envelope, which may, in transit, be covered with suitable release paper (not shown), In the packet is a deodorant insert 28 of any suitable known form of air freshening material having a chosen scent such as pine or lemon.

The tabs 20, 22 particularly adapt the packet 12 for adhesion to filter 10 on a corner as shown, with the tabs being secured along adjacent peripheral edges of the filter, the positioning of the packet in the filter corner providing minimum interference to airflow. However, the nature of the tabs allows the packet to be secured to the filter in any required location. Also, if required, more than one packet may be adhered to a filter element, for example, in the opposite corners thereof.

It will be seen from the foregoing that the invention provides a simple and effective means for deodorizing circulating air in a domestic dwelling or other building. While the invention has been described in relation to a sachet or pocket-type adhesive deodorant fitting for a air filter, it is understood that the deodorant agent may, in accordance with the invention, be associated with a filter by other means as previously alluded to.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. For use in scenting circulating air in a domestic dwelling or other building having air circulation ducting and mounting means in the ducting for an air filter, a packet containing air scenting material, and means for securing the packet to the filter in a position for scenting the air passing through the filter, wherein the packet is flat and rectangular and formed of perforated sheet material containing the scenting material, and the securing means comprises a fold-back adhesive-backed tab on one edge of the packet perpendicular to the plane of the packet.

2. The invention of claim 1 wherein the packet has a further adhesive-backed tab along an edge adjacent said one edge whereby the packet may be mounted in a corner of the filter with said tabs folded back and adhered along adjacent peripheral edges of the filter.

* * * * *